United States Patent [19]

Oguchi et al.

[11] Patent Number: 5,037,078

[45] Date of Patent: Aug. 6, 1991

[54] METHOD OF CONTROLLING AN AUTOMATIC SHEET CONNECTING AND FEEDING APPARATUS

[75] Inventors: Katsuaki Oguchi; Katsuhiko Takeuchi, both of Nagano, Japan

[73] Assignee: K.K. Sankyo Seiki Seisakusho, Nagano, Japan

[21] Appl. No.: 333,506

[22] Filed: Apr. 5, 1989

[30] Foreign Application Priority Data

| | | | |
|---|---|---|---|
| Apr. 5, 1988 | [JP] | Japan | 63-83509 |
| Apr. 5, 1988 | [JP] | Japan | 63-83510 |
| Apr. 5, 1988 | [JP] | Japan | 63-83511 |
| Apr. 7, 1988 | [JP] | Japan | 63-84100 |
| Apr. 7, 1988 | [JP] | Japan | 63-84101 |

[51] Int. Cl.[5] ..... B65H 39/00

[52] U.S. Cl. ..... 270/52; 156/507

[58] Field of Search ..... 270/32, 39, 52; 156/502, 505, 506, 507, 509

[56] References Cited

U.S. PATENT DOCUMENTS

| | | | |
|---|---|---|---|
| 3,776,795 | 12/1973 | Stevenson | 156/505 |
| 4,289,556 | 9/1981 | Booth | 156/506 |
| 4,421,590 | 12/1983 | Meschi | 156/506 |
| 4,564,184 | 1/1986 | Rumpel | 270/39 |
| 4,576,673 | 3/1986 | Lenzi | 156/502 |

FOREIGN PATENT DOCUMENTS

| | | | |
|---|---|---|---|
| 59981 | 9/1982 | European Pat. Off. | 156/502 |
| 8808372 | 11/1988 | PCT Int'l Appl. | 270/39 |

OTHER PUBLICATIONS

IBM Technical Brochure, "Spicer for Continuous Forms or Film"; vol. 15, No. 4, Sep. 1972.

*Primary Examiner*—Edward K. Look
*Assistant Examiner*—Therese M. Newholm
*Attorney, Agent, or Firm*—Sughrue, Mion, Zinn Macpeak & Seas

[57] ABSTRACT

A method for controlling an automatic sheet connecting and feeding apparatus in which folded sheets, each of which is folded zigzag in the form of a stack of sheets, are conveyed successively by a plurality of conveying means to a processing means. In order to connect the bottom sheet of a first one of the folded sheets to the top sheet of a second folded sheet following the first folded sheet the top sheet is lifted with a suction device. The step of lifting the first folded sheet includes the steps of pushing the suction device against the top sheet to suction and retain the top sheet, moving the suction device in parallel with the surface of the top sheet and moving the suction device in a direction perpendicular to the surface of the top sheet.

10 Claims, 6 Drawing Sheets

METHOD OF CONTROLLING AN AUTOMATIC SHEET CONNECTING AND FEEDING APPARATUS

BACKGROUND OF THE INVENTION

1. Field of the Invention

This invention relates to a method of controlling an automatic sheet connecting and feeding apparatus in which folded sheets are successively connected to each other.

2. Background

U.S. Pat. application Ser. No. 184,917 discloses an apparatus in which folded sheets, each of which is folded zigzag in the form of a stack of sheets are successively conveyed with conveying means, and are connected to one another during conveyance, so as to be fed to a processing device. In Japan, the apparatus has been laid open to public inspection under Japanese Patent Application Nos. 88675/1987, 88766/1987 and 88767/1987 (the term "OPI" as used herein means an "unexamined published application"). Such an apparatus is disclosed in Japanese Patent Application No. 145058/1986.

The difficulties associated with such an apparatus are as follows. When the top sheet of a folded sheet is lifted by suction and retained by a suction and retaining means and is positioned so as to be connected to the bottom sheet of the preceding folded sheet the elasticity of the sheet causes the top sheet to become detached from the suctioning and retaining means that is, it is difficult for the suctioning and retaining means to positively suction and retain the top sheet. Sometimes, the suction and retaining means may suction and retain more than one sheet.

Furthermore, in order to position the top and bottom sheets for connecting them to each other, positioning pins are inserted into positioning holes. However, since the folded sheets are heavy the sheets may not be properly positioned, and the positioning holes may be broken.

The conventional apparatus has no means for detecting whether or not the sheet have been satisfactorily connected to each other. Therefore, the sheets are often disconnected from each other, with the result that the feeding of folded sheets to the following processing device is suspended, and accordingly the device must be stopped.

Further, the sheets of the folded sheet on the last conveyor are fed to the processing device at high speed. Therefore, if the number of sheets remaining on the last conveyor becomes small, the folded sheet on the last conveyor is pulled in a direction opposite to the sheet forwarding direction against the frictional resistance between the folded sheet and the conveyor. In this case, a sheet detecting means at the last stage determines that no folded sheet is available on the last conveyor, and operates to move the folded sheet on the preceding conveyor to the last conveyor, as a result of which the sheets remaining on the last conveyor are caught between the folded sheet thus moved and the apparatus frame; that is, the feeding of the sheets to the processing device is suspended.

SUMMARY OF THE INVENTION

The object of the present invention is to eliminate the above-described difficulties accompanying the convention method. This object and other objects which will become apparent from the ensuing description of the preferred embodiment of the invention, are accomplished by a method for controlling an automatic sheet connecting and feeding apparatus in which folded sheets, each of which is folded zigzag in the form of a stack of sheets, are conveyed successively by a plurality of conveying means to a processing means, in which in order to connect the bottom sheet of a first one of said folded sheets to the top sheet of a second folded sheet following said first folded sheet, an operation of lifting said top sheet with a suctioning device comprises the steps of pushing the suctioning device against the top sheet to suction and retain the latter, moving the suctioning device while suctioning and retaining the top sheet in parallel with the surface of said top sheet, and moving the suctioning device in a direction perpendicular to the surface of said top sheet.

DETAILED DESCRIPTION OF THE PREFERRED EMBODIMENT

Figure 1:
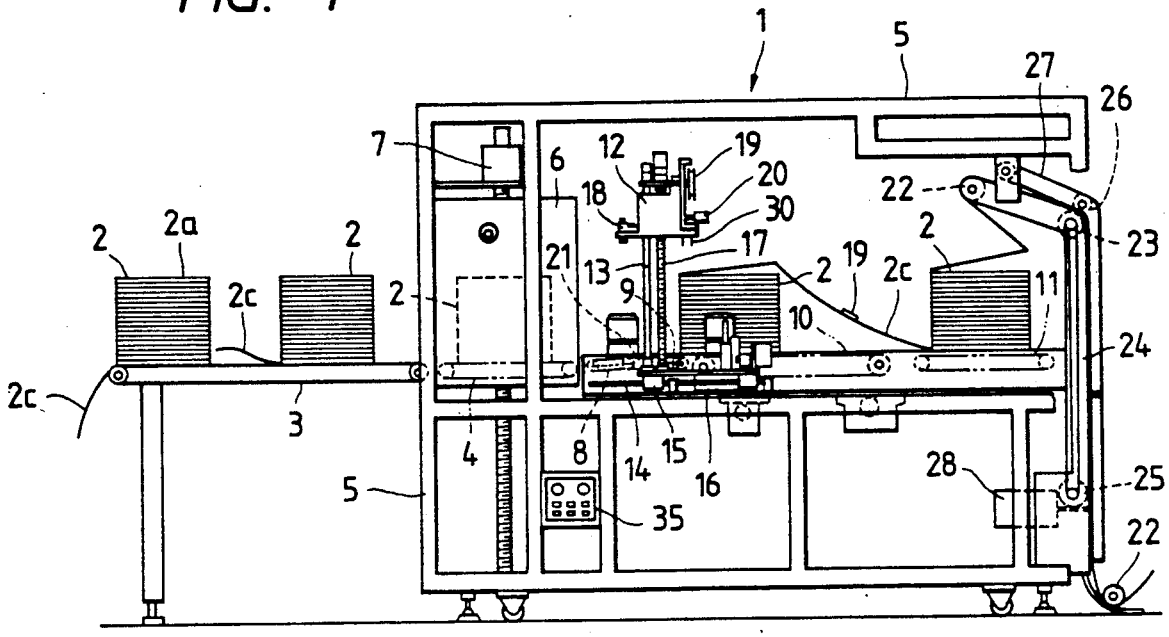
FIG. 1 is a side view showing the arrangement of an automatic sheet connecting and feeding apparatus.

FIG. 1 outlines the arrangement of an automatic sheet connecting and feeding apparatus 1 to which the technical concept of the invention is applied.

In FIG. 1, reference numeral 2 designates a long sheet which is folded zigzag as if a number of sheets were stacked (hereinafter referred to as "a zigzag folded sheet 2" or merely as "a folded sheet 2", when applicable). The folded sheet 2 is first loaded on a supply conveyor 3 with its bottom sheet 2*c* pulled out and then forwarded to a hopper conveyor 4. The hopper conveyor 4 is connected to a lifter 6 in a apparatus frame 5 in such a manner that it is movable vertically with an elevating unit 7.

Figure 2:
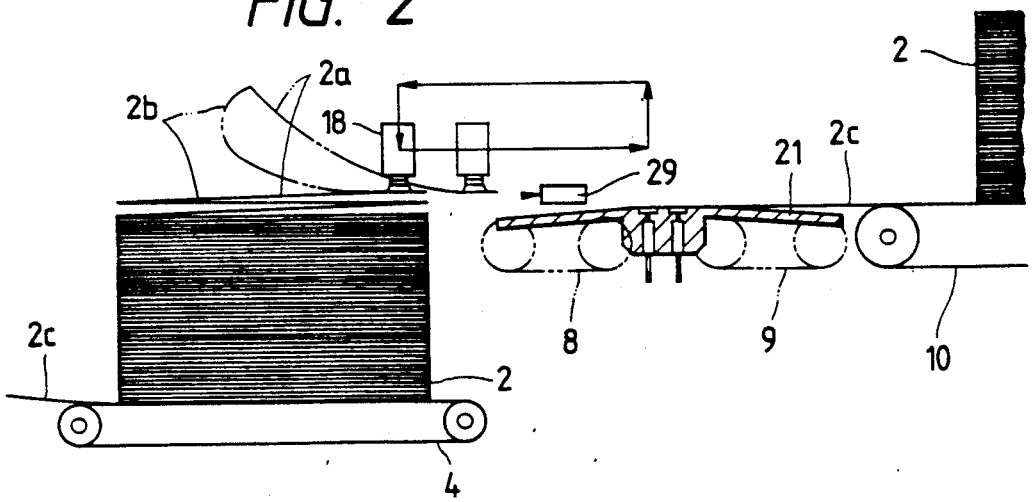
FIGS. 2 through 8 are diagrams for describing the operation of the apparatus shown in FIG. 1.
Figure 3:
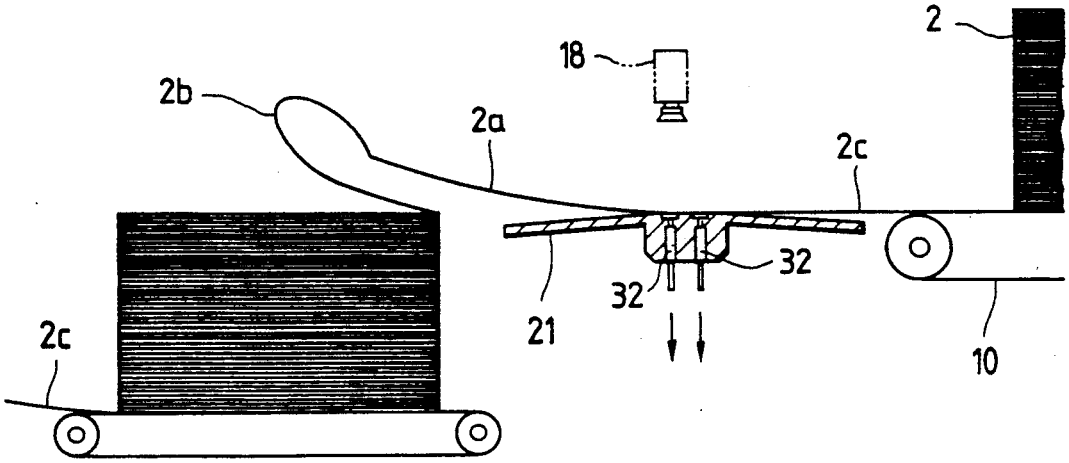
Figure 4:
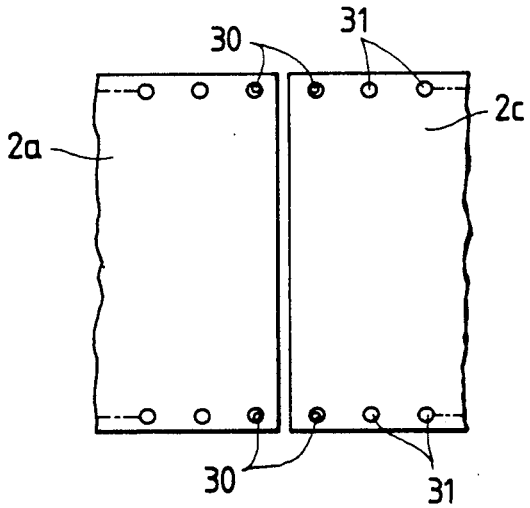

The apparatus 1 has first, second, third and fourth belt conveyors 8, 9, 10 and 11 in the frame 5 in order to forward a plurality of folded sheets 2 successively. In order that the bottom sheet 2*c* of a first folded sheet 2 and the top sheet 2*a* of the following folded sheet 2 are connected to each other after being positioned, a connecting unit 12 is provided near the first and second belt conveyors 8 and 9. The connecting unit 12 is vertically movable by means of a gate-shaped frame 13 and a vertical feed screw unit 17, and is movable back and forth in the direction of conveyance of a folded sheet 2 by means of a horizontal guide rod 14 secured to the frame 5 beside the first and second belt conveyors 8 and 9, a slider 15 slidably mounted on the guide rod 14, and a driving cylinder 16. The connecting unit 12 has a plurality of suction and retaining pads 18 arranged in the direction of width of the folded sheet 2 to suction and retain the top sheet 2*a* of the following folded sheet 2, and two positioning pins 30 extending downwardly to locate the ends of the top and bottom sheets 2*a* and 2*c* to position them. A connecting tape 19 sticking unit 20 is provided in such a manner that it is movable in the direction of width of the folded sheet 2. As shown in FIGS. 2–4, one of the two positioning pins 30, which is on the upstream side of the conveyance path, confronts with the sprocket hole 31 of the following top sheet 2*a* at a connecting table 21, and the other positioning pin 30 on the downstream side confronts with the sprocket hole 31 of the preceding bottom sheet 2*c*.

The automatic sheet connecting and feeding apparatus 1 has a guide roller 22 and a feed roller 23 at the sheet feeding position for a high speed printer which are mounted on brackets 24 secured to the frame 5. The feed roller 23 is forcibly driven by a feed motor 25. A push roller 26 is abutted against the feed roller 23 in such a manner as to hold the following folded sheet 2 therebetween. The push roller 26 is mounted on movable brackets 27, the upper end portions of which are rotatably coupled to the apparatus frame 5. The push roller can be moved away from the feed roller with an air cylinder 28.

A sheet suctioning and retaining method according to the invention is practiced when folded sheets 2 are connected.

As was described above, a folded sheet 2 is delivered from the supply conveyor 3 to the hopper conveyor 4 with a bottom sheet 2*c* pulled out as shown in FIG. 1, and held in that position. Under this condition, the lifter 6 is moved downwardly by the elevating unit until the top sheet 2*a* becomes substantially flush with the upper surface of the connecting table as shown in FIG. 2.

In this operation, the suction and retaining pads 18 are moved downwardly to the top sheet 2*a* of the folded sheet 2 on the hopper conveyor 4. Under this condition, first the pads 18 abut against the upper surface of the top sheet 2*a*, and suction and retain it with a suctioning air stream. Then, the pads 18 move in a direction parallel to the upper surface of the top sheet 2*a*, namely, in a sheet forwarding direction while suctioning and retaining the top sheet 2*a*. In this operation, if necessary, a sheet-separating air stream is applied to the cut end of the folded sheet 2 with an air nozzle 21. When the pads 18 are moved in the sheet forwarding direction while suctioning and retaining the top sheet 2*a* as described above, the top sheet 2*a* and the second sheet 2*b* are shifted, in parallel, from each other, as a result of which the second sheet 2*b* is curved, thus tending to restore itself by its own stiffness. Therefore, even if the suctioning and retaining pads 18 suction and retain both the top sheet 2*a* and the second sheet 2*b*, the top sheet 2*a* and second sheet 2*b* are positively separated from each other because they are shifted from each other as was described above and because the restoring force of one sheet is different from that of both sheets together. Thus, because the stiffness of one sheet 2*a* suctioned and retained by the pads 18 is different from that of more than one sheet (2*a* and 2*b*) suctioned and retained by the pads 18, the two sheets are shifted so as to be separated from each other, and the sheet separating air stream is allowed to flow into the gap formed between the two sheets, as a result of which the two sheets are positively separated from each other.

When the following folded sheet is supplied in alignment with the upper surface of the connecting table, the top sheet thereof is substantially flush with the positioning surface of the connecting table, and therefore no air stream enters between the following folded sheet and the connecting table, with the result that the suctioning nozzles of the connection table will operate positively.

When the top of the following folded sheet is substantially flush with the positioning surface of the connecting table, the second sheet following the top sheet is sufficiently curved. The restoring force attributing to the stiffness is not exerted on the second sheet, and accordingly the top sheet on the connecting table will not be moved backwardly; that is, it is held in position. Therefore, the sheet positioning operation and the sheet splicing operation can be achieved with high accuracy.

In the following step, the suction and retaining pads 18 moves the cut end of the top sheet 2*a* to the middle of the connecting table 21, and stop there while holding the top sheet 2*a*. Thereafter, the pads suspend the suctioning and retaining of the top sheet 2*a*, move upwardly and return to the original position.

On the other hand, the preceding folded sheet 2 is on the third conveyor 10 with the end of the bottom sheet 2*c* held on the connecting table 21. During this period, at the connecting table 21, suctioning nozzles arranged before and after in the sheet forwarding direction suction the lower surfaces of the top sheet 2*a* and bottom sheet 2*c* as shown in FIG. 3; that is, the top sheet 2*a* and bottom sheet 2*c* are retained on the connecting table 21 by a negative suction force and by a frictional force.

Figure 5:
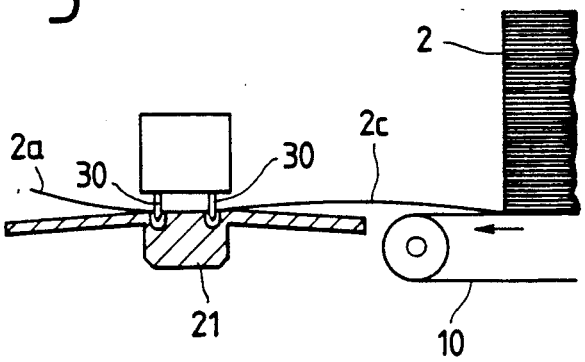

Under this condition, the connecting unit 12 is moved downwardly until, on each of the two sides of the top sheet 2*a* and bottom sheet 2*c*, the tapered end portions of the two positioning pins 30 are inserted into the sprocket holes 31 of the sheets 2*a* and 2*c* as shown in FIG. 4, so that the sheets are temporarily positioned. In this operation, the positioning pins are not completely inserted into the sprocket holes 31; that is, only the tapered end portions thereof are inserted thereinto, and therefore the bottom sheet 2*c* is movable on the connecting table 21 in the position opposite to the sheet forwarding direction (hereinafter referred to as "a reverse direction", when applicable). After the top sheet 2*a* and bottom sheet 2*c* have been temporarily positioned in the above-described manner, the third conveyor 10 moves the folded sheet 2 disposed thereon in the reverse direction so that the end of the bottom sheet 2*c* is abutted against the end of the top sheet 2*a* of the following folded sheet 2 as shown in FIG. 5. Thus the ends of the top sheet 2*a* and bottom sheet 2*c* are abutted against each other with no gap therebetween. Thereafter, the positioning pins 30 are further moved downwardly; that is, the large diameter portions thereof are inserted into the sprocket holes 31 to completely retain the sheet parts 2*a* and 2*c* thus abutted. Of the positioning pins 30, at least those which confront with the bottom sheet 2*c* should have the above-described tapered end portions to achieved the above-described operation.

According to the invention, after the sheets have been temporarily positioned the preceding folded sheet is moved backwardly so that its end is abutted against the end of the following folded sheet with the bottom sheet bent. Therefore, when the positioning pins are completely inserted into the sprocket holes, the bottom sheet is positioned and is move within the range permitted by the bending thereof, and the sprocket holes will not be damaged by the positioning pins.

Figure 6:
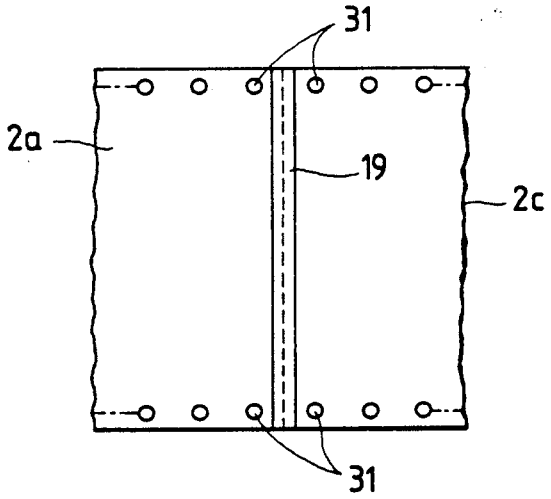

The adhering unit 20 operates as follows: As shown in FIG. 6, the adhering unit 20 adheres the connecting tape 19 to one end of the connecting line of the top sheet 2*a* and bottom sheet 2*c*, for instance, by thermal welding, and is then moved along the connecting line, so that the top and bottom sheets 2*a* and 2*c* are connected with the connecting tape 19.

Figure 8:
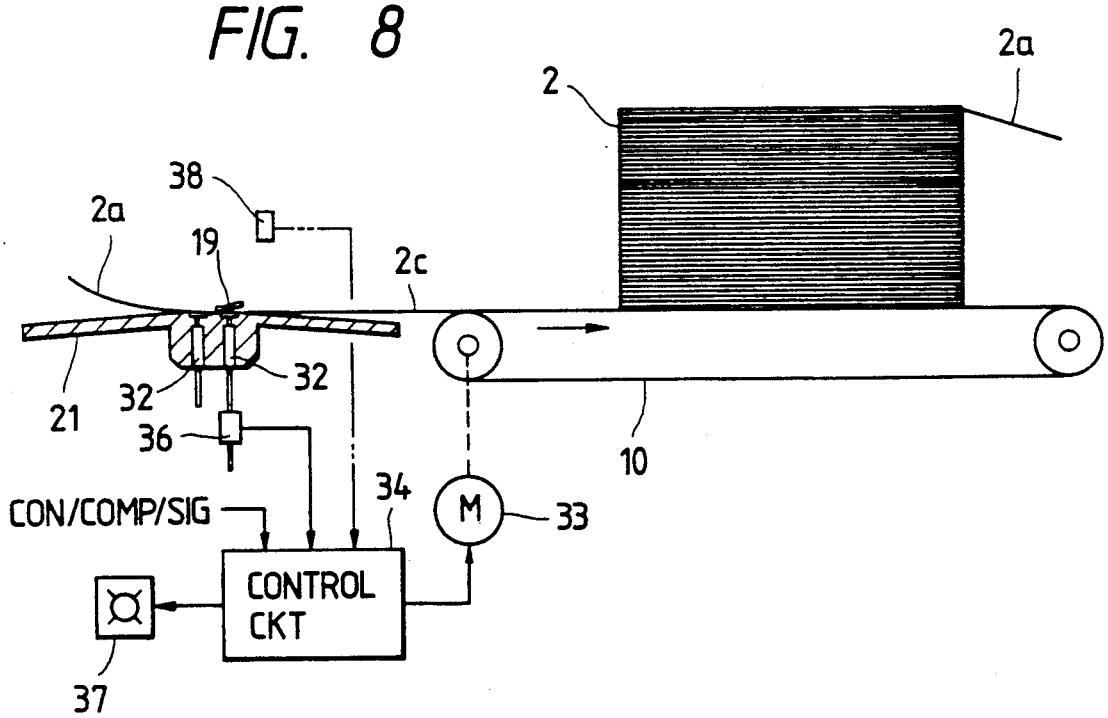
Figure 9:
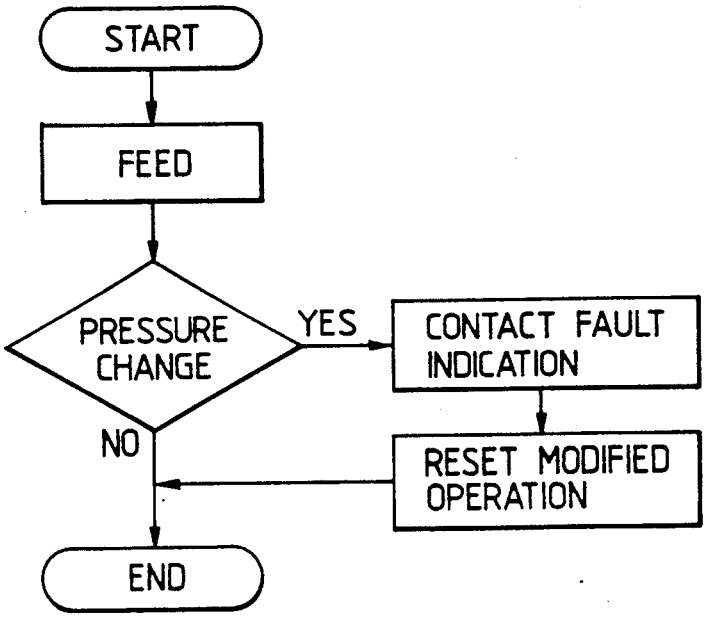
FIG. 9 is a flow chart for determining whether or not sheets have been connected satisfactorily to each other.

Upon completion of the above-described sheet part connecting operation, a sequence control unit 35 of the apparatus 1 applies a connection completion signal to a control circuit 34 (FIG. 8). In response to the signal, the control circuit 34 starts a program as shown in FIG. 9. In the first step, a drive motor 33 is rotated in the sheet forwarding direction as much as a predetermined number of revolutions to convey the folded sheet 2 on the third conveyor 10 in the sheet forwarding direction.

Figure 7:
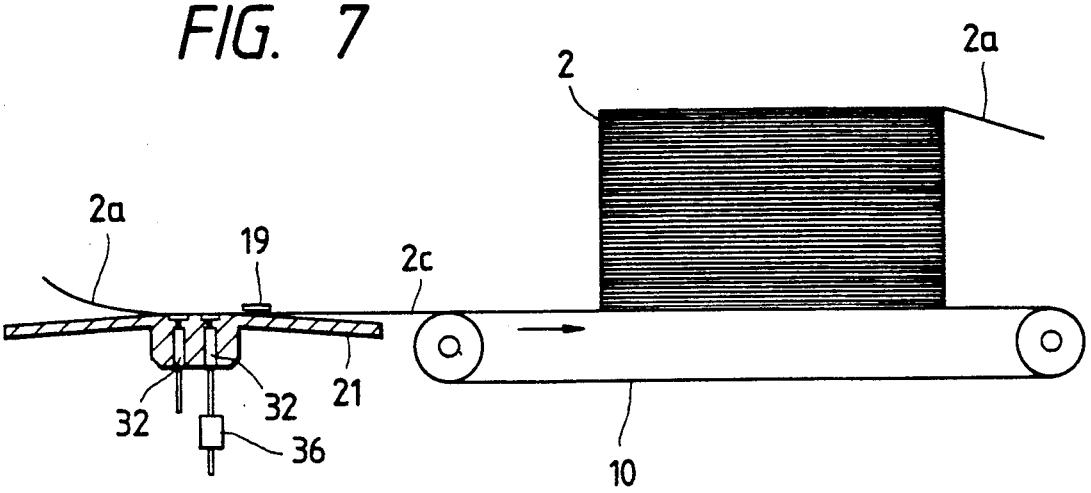

After top and bottom sheets 2*a* and 2*c* have been completely connected to each other, they are moved as much as the folded sheet 2 on the third conveyor 10 as shown in FIG. 7. During this sheet forwarding operation, the suctioning nozzles 32 continue to operate. Therefore, the top and bottom sheets 2*a* and 2*c* together with the folded sheet 2 are moved in the same direction while being subjected to frictional resistance on the upper surface of the connecting table 21.

If the top and bottom sheets 2*a* and 2*c* are not completely connected to each other or their connection becomes unsatisfactory as shown in FIG. 8, the preceding bottom sheet 2*c* leaves the connecting tap 19 with the following top sheet 2*a* held on the connecting table 21, so that the suctioning nozzles 32 arranged on the downstream side, as viewed in the sheet forwarding direction, are opened.

As a result, the pressure in the suctioning nozzles 32 is abruptly changed. Therefore, in the following step, the control circuit 34 detects the change in pressure with a pressure sensor 36, and provides a warning by indicating the unsatisfactory connection. In response to the warning, the operator manually corrects the unsatisfactory connection and resets the warning indication. Thus, the unsatisfactory connection detecting program has been carried out.

According to the invention, after the preceding and following sheets have been connected at least one of them is moved away from the other. Therefore, it can be automatically detected from the separation of the two sheets whether or not they are connected satisfactorily. With the apparatus of the invention, the difficulty can be prevented regarding the connection of the two sheets becoming unsatisfactory immediately before being supplied into the high-speed printer or the two sheets being disconnected during conveyance, and therefore the folded sheets can be continuously fed to the printer.

In the above-described embodiment, the separation of the top and bottom sheets 2*a* and 2*c* is detected from the change in pressure in the suctioning nozzles 32; however, it may be detected by the following method: For instance, a photo sensor 38 may be disposed above the connecting line of the two sheets, so that the separation of the sheets is detected by the change in luminance of the detecting surface. In addition, both methods may be employed in combination that is, the change in pressure and the change in luminance may be detected and added for detection of the unsatisfactory state of the two sheet parts. In the above-described embodiment, the bottom sheet 2*c* is moved; however, the top sheet 2*a* may be moved, or both of the sheet parts 2*a* and 2*c* may be moved.

Figure 10:
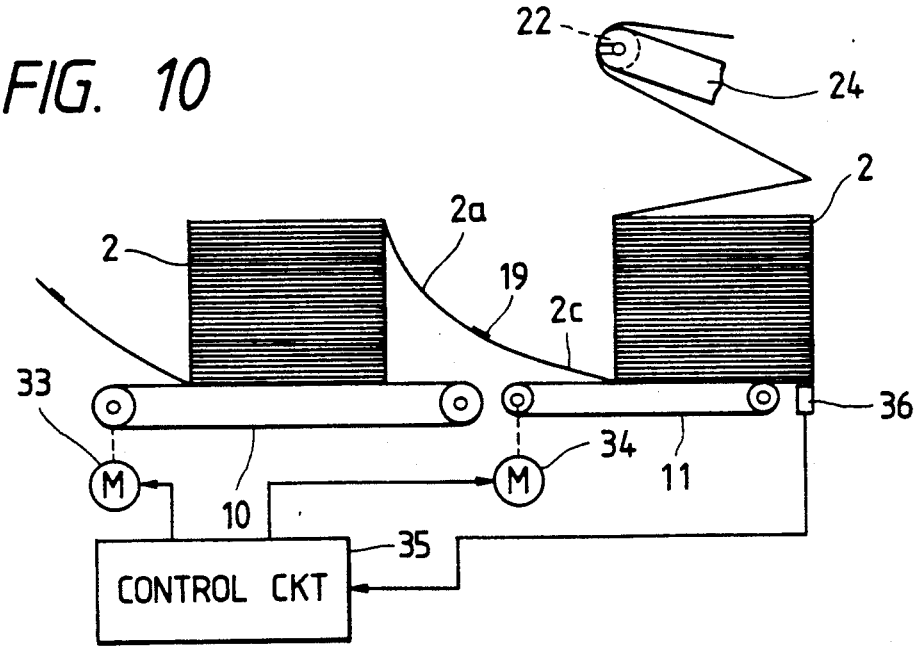
FIGS. 10, 12 and 13 are explanatory diagrams for describing a conveyor driving method according to the invention.

As shown in FIGS. 1 and 10, the top sheet of the preceding folded sheet 2 is folded at the upper guide roller 22, and forwarded while being held between the feed roller 23 and the retaining roller 26. Thus, the folded sheet 2 is automatically fed into a high-speed printer or the like through the lower guide roller 22. Of course, the above-described folded sheets feeding and connecting operations are carried out in association with the sheet consuming speed of the high-speed printer.

Figure 11:
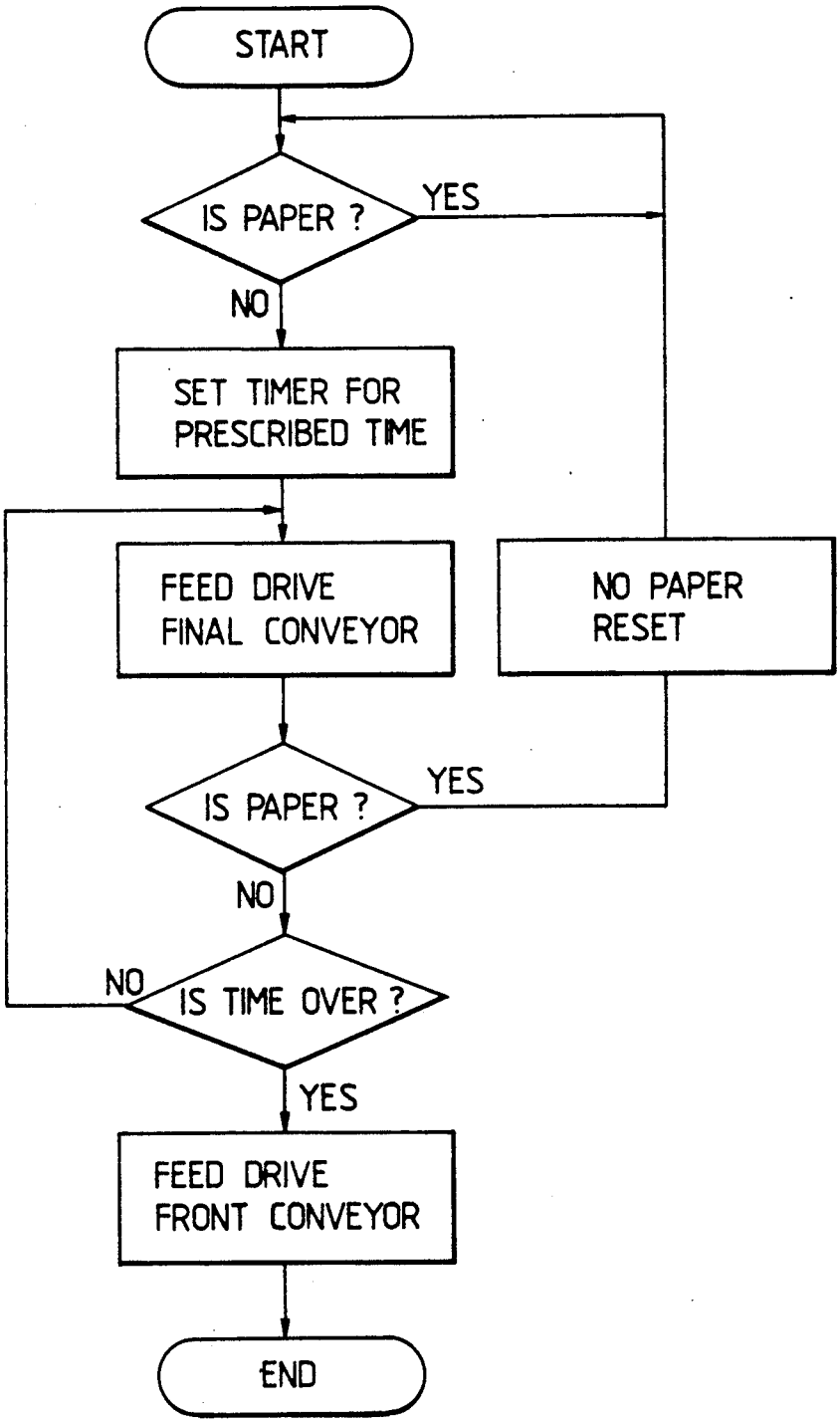
FIG. 11 is a flow chart for describing the conveyor driving method.

In the above-described operation, the control circuit 35 executes a program as shown in FIG. 11.

Figure 12:
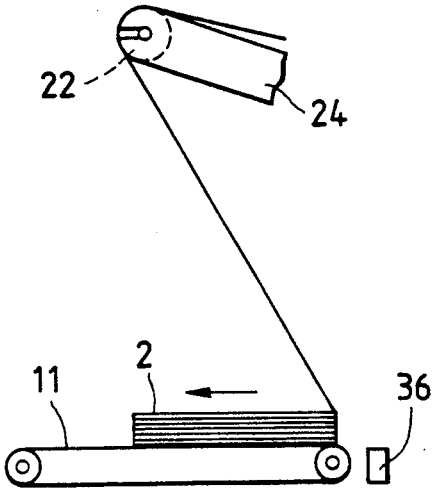
Figure 13:
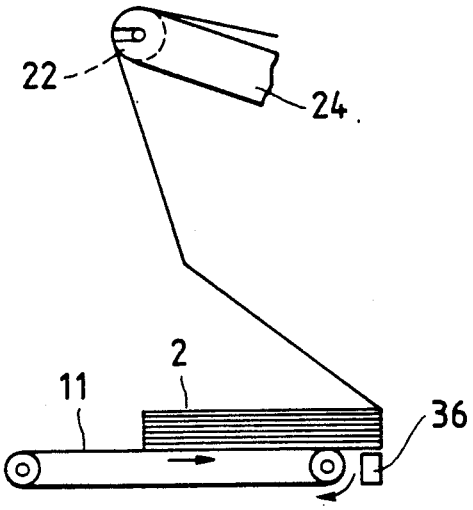

While the folded sheet 2 on the last conveyor 11 is supplied to the high-speed printer, the control circuit 35 detects with detecting means 36 whether or not the folded sheet 2 is available on the conveyor. When the amount of sheets on the folded sheet remaining on the conveyor becomes small, and the front fold of the folded sheet is pulled the folded sheet 2 in the form of a stack of sheets is subjected to a component of force in the reverse direction as shown in FIG. 12 thus being moved backwardly on the conveyor 11. In this operation, the detecting means 36 detects that no sheet is available, and applies such a signal to the control circuit 35. When the rear fold of the folded sheet is pulled, the remaining folded sheet 2 is merely moved in the sheet forwarding direction sliding on the conveyor 11, and the detecting means 36 will not detect that a folded sheet is an available.

In this case, the control circuit 35 sets a timer to a predetermined time, and then rotates the motor 34 in the forward direction so that the conveyor 11 is moved a predetermined distance in the sheet forwarding direction. If, after this movement, the detecting means 36 detects that the folded sheet is available then according to the program the state that no folded sheet is available is reset, and the initial step is effected again. If when the time set with the timer has passed and the conveyor 11 has been rotated in the sheet forwarding direction and it is not detected that the folded sheet is available, then the control circuit 35 determines that no folded sheet is originally available. As a result, the control circuit 35 starts the motor 33 to rotate the conveyor 10 (preceding the conveyor 11) in the sheet forwarding direction, to convey the folded sheet 2 disposed thereon to the conveyor 11 and then rotates the conveyor 11 as much as predetermined in the sheet forwarding direction, thus supplying the folded sheets successively.

The detecting means 36 may be a photo sensor, contact type sensor, or weight sensor.

When it is detected that no folded sheet is available on the last conveyor, the latter is driven in the sheet forwarding direction once. After the last conveyor has been operated in this manner and still no folded sheet is detected on the last conveyor, the preceding conveyor supplies the folded sheet to the last conveyor. This prevents the erroneous supplying of the following folded sheet.

What is claimed is:

1. A method of controlling an automatic sheet connecting and feeding apparatus in which folded sheets, in a fan folded arrangement in the form of a stack of sheets, are conveyed successively by a plurality of conveying means to a processing means, in which in order to connect the bottom sheet of a first stack of said folded sheets to the top sheet of a second stack following said first stack, an operation of selectively grasping, separating from a next sheet and delivering said top sheet to a connecting area with sucking means comprises the steps of:

(a) pushing said sucking means against said top sheet to suck and retain the latter, (b) moving said sucking means which is sucking and retaining said top sheet, in a predetermined direction and along a plane defined by a feeding end of said second stack such that said top sheet is slid along said plane to cause major facing surfaces of said top sheet and a next sheet in said second stack to shift in parallel with respect to each other and thus become separated, and (c) once major facing surfaces of said top sheet and said next sheet become separated, moving said sucking means to deliver said top sheet to said connecting area.

2. A method as claimed in claim 1, in which said operation of moving said sucking means to separate said top sheet is carried out under the condition that the surface of said top sheet of said second stack is made substantially flush with the surface of said bottom sheet of said first stack.

3. A method of controlling an automatic sheet connecting and feeding apparatus in which folded sheets with position holes, each of which are folded zigzag in the form of a stack of sheets, are conveyed by a plurality of conveying means successively, in which the rear end of the bottom sheet of a first one of said folded sheets and the front end of the top sheet of a second folded sheet following said first folded sheet are connected to each other after being confronted with each other, comprises the steps of:

(a) inserting only tapered portions of positioning pins into said positioning holes;

(b) moving said first folded sheet towards said second folded sheet as much as a predetermined distance; and (c) further inserting said positioning pins into said positioning holes until the tapered portions thereof pass through said positioning holes, to position said folded sheets.

4. A method as claimed in claim 3, in which said positioning holes of said folded sheets are sprocket holes for conveying said folded sheets.

5. A method of controlling an automatic sheet connecting and feeding apparatus in which the ends of successive stacks of fan folded sheets are automatically connected, comprising the steps of:

providing a first and second stack of sheets;

vertically adjusting said second stack to position the upper surface of said second stack flush with a positioning surface; and connecting a rear end of a bottom sheet of said first stack to a front end of said top sheet of said second stack with connecting means during conveyance, said connecting step comprising the steps of insuring that the upper surface of said second stack is made substantially flush with said positioning surface, suctioning and lifting a top sheet of said second stack with sucking means, and abutting the front end of said second folded sheet against the rear end of said first folded sheet.

6. A method of controlling an automatic sheet connecting and feeding apparatus in which the ends of successive stacks of fan folded sheets are automatically connected, comprising the steps of:

providing first and second stacks of sheets;

providing a plurality of conveying means for conveying said stacks of fan folded sheets, one conveying means of said plurality of conveying means being located before a connecting means and being moveable in a vertical direction, perpendicular to a feed surface of said stacks of fan folded sheets;

conveying said second stack of fan folded sheets to said one conveying means; and moving said one conveying means so that the upper surface of said second stack of fan folded sheets is made substantially flush with a positioning surface for performing a connection operation, thereby positioning the upper surface of said second folded sheet flush with said positioning surface; and connecting the rear end of a bottom sheet of said first stack of fan folded sheets to the front end of a top sheet of said second stack of fan folded sheets following said first stack with connecting means during conveyance, said connecting step comprising the steps of insuring that the upper surface of said second folded sheet is made substantially flush with a positioning surface therefor, suctioning and lifting the top sheet of said second folded sheet with sucking means, and abutting the front end of said second folded sheet against the rear end of said first folded sheet.

7. A method of controlling an automatic sheet connecting and feed apparatus in which folded sheets, each of which is folded zigzag in the form of a stack of sheet parts, are conveyed successively by a plurality of conveying means, comprising the steps of:

confronting the rear end of the bottom sheet of a first one of said folded sheets and the front end of the top sheet of a second folded sheet following said first folded sheet with each other;

positioning said bottom sheet and said top sheet by sucking means;

connecting said bottom sheet and said top sheet to each other; and detecting whether or not said sheet parts are separated from each other by moving at least one of said sheets thus connected away from each other, thereby to determine whether or not said sheet parts has been satisfactorily connected with each other.

8. A method as claimed in claim 7, in which said step of detecting whether or not said sheet parts has been satisfactorily connected with each other is determined by detecting the change in pressure in said sucking means.

9. A method as claimed in claim 7, in which said step of detecting whether or not said sheet parts has been satisfactorily connected with each other is determined with an optical sensor arranged near a sheet connecting section.

10. A method of controlling an automatic sheet connecting and feeding apparatus in which folded sheets each of which is folded zigzag in the form of a stack of sheet parts, are conveyed successively by a plurality of conveying means, and are connected to one another and successively fed to a processing device, comprising the steps of:

(a) detecting whether or not a folded sheet is available on a last one of said conveying means;

(b) when said detecting means detects that no folded sheet is available on the last conveying means, driving said last conveying means in a sheet forwarding direction for a predetermined period of time; and (c) when said detecting means detects no folded sheet after said last conveying means is driven in the sheet forwarding direction for said predetermined period of time, driving a conveying means preceding said last conveying means to convey a folded sheet therefrom to said last conveying means.

* * * * *